United States Patent [19]

Silverberg

[11] 4,381,860

[45] May 3, 1983

[54] PADDLE WHEEL RETARD FEEDER

[75] Inventor: Morton Silverberg, Rochester, N.Y.

[73] Assignee: Xerox Corporation, Stamford, Conn.

[21] Appl. No.: 203,004

[22] Filed: Nov. 3, 1980

[51] Int. Cl.[3] ..... B65H 3/06

[52] U.S. Cl. ..... 271/10; 221/251; 221/259; 221/260; 271/120; 271/122

[58] Field of Search ..... 271/120, 119, 118, 122, 271/121, 37, 10, 245, 246, 264, 314; 221/259, 260, 251; 414/123, 129

[56] References Cited

U.S. PATENT DOCUMENTS

| | | | |
|---|---|---|---|
| 311,340 | 1/1885 | Loffelhardt | 271/119 UX |
| 576,116 | 2/1897 | Hansen | 271/121 |
| 1,167,367 | 1/1916 | Wells . | |
| 2,953,372 | 9/1960 | Williams et al. | 271/236 |
| 3,220,605 | 11/1965 | Casey | 271/120 X |
| 3,469,834 | 9/1969 | Stange et al. | 271/10 |
| 3,630,516 | 12/1971 | Hong | 271/120 X |
| 3,690,537 | 9/1972 | Turner et al. | 227/88 |
| 4,171,129 | 10/1979 | Daley et al. | 271/10 X |

*Primary Examiner*—Bruce H. Stoner, Jr.

[57] ABSTRACT

An apparatus for feeding individual substrates from the top of a stack of substrates upon demand includes a first paddle wheel mounted above the substrate stack and adapted to forward a substrate from the stack in a predetermined direction and a second paddle wheel downstream from the first paddle wheel that is adapted to continue movement of the substrate in the predetermined direction. A friction retard roller is positioned opposite to and forms a nip with the second paddle wheel in order to inhibit multi-feeding of substrates. A second embodiment includes a single paddle wheel that acts in combination with a high friction surfaced guide member to feed substrates individually from a stack.

2 Claims, 5 Drawing Figures

PADDLE WHEEL RETARD FEEDER

BACKGROUND OF THE INVENTION

This invention relates generally to an electrophotographic printing machine, and more particularly concerns an improved paddle wheel substrate feeding system for feeding substrates, which term is used herein to include sheets of any type, from a stack along a predetermined path.

Feeding sheets from a stack may be viewed as involving three separate problems. The first is separating a sheet or sheets from a stack. The second is queuing the separated sheets into an order such as that corresponding to their order in the stack, e.g. outermost sheets followed by the adjacent intermost sheets. The third problem is advancing the queued sheets into the sheet processing system being served by the feeding mechanism.

Sheet separation with a belt and retard roller appear in the sheet handling art at least as early as 1916 in U.S. Pat. No. 1,167,367 to P. L. Wells and as recently as 1969 in U.S. Pat. No. 3,469,834 to Stange et al. The separation belt and retard roller are employed in these patents for queuing and advancing the sheets but not for separating them from the stack. In the patents, the region of contact between the roller and belt form a sheet queuing throat which is able to "fan out" or queue sheets passed through it. The sheets are separated from a stack and fed to the throat by a presser foot in the Wells, U.S. Pat. No. 1,167,367 and by a nudger or feed wheel in the Stange et al, U.S. Pat. No. 3,469,834.

In addition, numerous devices such as impact/paddle feeders of the type disclosed in U.S. Pat. No. 3,630,516 have been employed to minimize the possibility of misfeeds or multi-feeds. The continued search for feeders that minimize mis-feeds and multi-feeds and can handle wider ranges of copy paper or documents have been necessitated by the complexity of modern sheet processing machines, such as, printers, sorters, collators, reproduction machines, etc., since a mis-feed or multi-feed causes machine shut downs. As an improvement, the present top feeder combines friction retarding and paddle wheel feeding to provide for low cost but reliable single sheet separation and feeding from a stack.

SUMMARY OF THE INVENTION

Accordingly, in one aspect of the invention, a substrate feeder comprises in combination, support means for supporting a stack of substrates, first paddle wheel means mounted above and slightly removed from the front edge of the sheet stack, second paddle wheel means located in line with and downstream of said first paddle wheel, retard means adjacent said second paddle wheel forming a nip therebetween, and registration means adapted to receive substrates forwarded by said first and second paddle wheels for registration and subsequent forwarding for further processing.

In another aspect of the invention, a substrate feeder is disclosed that comprises support means for supporting a stack of substrates, paddle wheel means mounted above said stack of substrate for feeding substrates from said stack, said paddle wheel means having an axis located in front of the lead edge of the substrate stack, and friction surfaced guide means positioned adjacent to the stack lead edge, whereby substrates contacted by said paddle wheel are forwarded through a nip formed between said paddle wheel and said guide means individually.

BRIEF DESCRIPTION OF THE DRAWINGS

The foregoing and other features of the instant invention will be more apparent from a further reading of the specification and claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
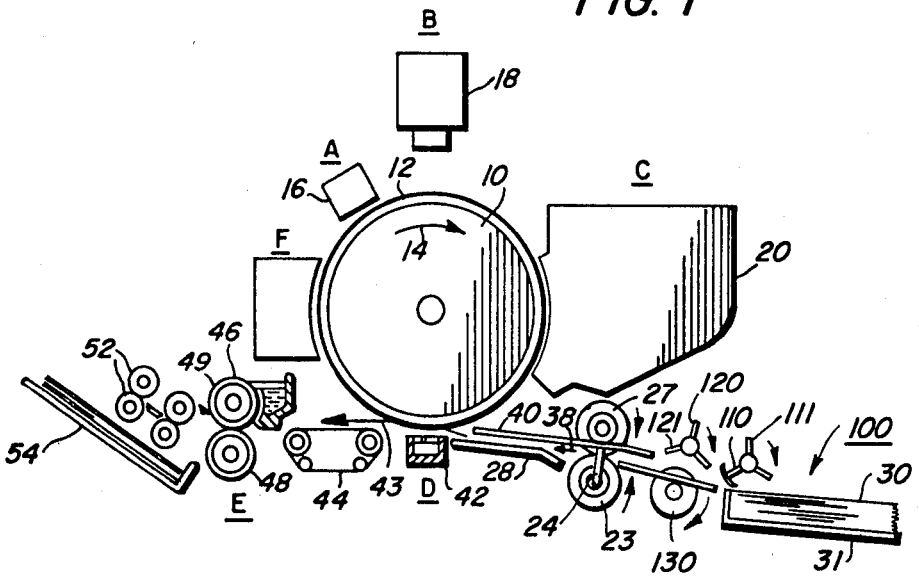
FIG. 1 is a schematic elevational view of an electrophotographic printing machine incorporating the features of one aspect of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art, will appreciate that it may also be employed for feeding successive original documents.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high substantially uniform potential. A suitable corona generating device is described in U.S. Pat. No. 2,836,725 issued to Vyverberg in 1958.

Thereafter drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a direction flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 100 to transfer station D. Sheet feed apparatus 100 advances successive copy sheets to forwarding registration rollers 23 and 27. Forwarding registration roller 23 is driven conventionally by a motor (not shown) in the direction of arrow 38 thereby also rotating idler roller 27 which is in contact therewith in the direction of arrow 38. In operation, feed device 100 operates to advance the uppermost sheet from stack 30 into registration rollers 23 and 27 and against registration fingers 24. Fingers 24 are actuated by conventional means in timed relation to an image on drum 12 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by finger 24, it is advanced through a chute formed by guides 28 and 40 to transfer station D.

Continuing now with the various processing stations, transfer station D includes a corona generating device 42 which applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by conventional rollers 52 to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 1 depicts the top feeder system in greaterdetail.

Referring now more specifically to FIG. 1, the detailed structure and operation of an aspect of the present invention will be described. Sheets 30 are shown stacked on platform 31 that has a conventional lift mechanism therein, such as springs, or an elevator that maintains the stack in correct striking distance to the feed members. This aspect of the invention combines paddle wheel inertial separation and registration capabilities with the additional separation capability of friction retard. Paddle wheel 110 serves to advance the top sheet in stack 30 into the nip formed between second paddle wheel 120 and retard roller 130. The inertial separating capability of blades III that have high friction tips striking the top of stack 30 usually results in advancing one sheet at a time. The lead edge of the separated sheet is then caught between blades 121 of paddle wheel 120 and retard roll 130. The surface of retard roll, or if desired pad, 130 is covered with a friction material whose coefficient of friction is higher than paper to paper, but less than blade to paper. This resulting differential friction force in favor of paddle wheel blades thus continues to urge the sheet in a forward direction. When the lead edge reaches registration fingers 24, the alternate forward impulses from the two paddle wheels register and deskew the sheet against the fingers. When triggered by conventional means, the fingers are removed from the path of the sheet and registration rolls 23 and 27 drive the lead edge of the sheet in synchronism with an image on drum 10.

If by chance two or more sheets are forwarded by first paddle wheel 110, the actions of feeder 100 are significantly different. As the second paddle wheel 120 rotates in the direction of the arrow, the blades press the sheets against retard roll 130 with the resulting shear forces tending to separate the sheets and cause at least the bottom most sheet to move backwards toward stack 30. The blades 121 of second paddle wheel 120 operate out of phase with the first paddle wheel 110. This facilitates (1) advancing of the sheets into the retard nip, and (2) the retard shearing forces do not have to cope with the friction forces caused by paddle wheel 110. Unique features of this embodiment of the invention include the extended retard nip due to the paddle wheel conformability to the retard roll and the continued separation attempts while the sheet being fed pauses after its lead edge reaches registration fingers 24.

Various means could be employed to maintain a gap between sheets, for example, one could operate the take away registration rolls at a speed substantially faster than the maximum paper speed achieved by the paddle wheels. This would enable the trail edge of the sheet in transit to travel the distance between the first paddle wheel 110 and the registration roll gate or fingers 24 before the next sheet can cover the distance from the retard roll 30 to the registration fingers. Alternatively, the paddle wheels could be stopped or slowed down after the lead edge of the top sheet is acquired by the take away rolls 23 and 27. Another alternative is to lower the stack or raise the first paddle wheel 110 after the lead edge of the top sheet is acquired by the take away registration rolls 23 and 27. Yet another alternative method of maintaining a gap between sheets would be to raise an inteceptor gate just beyond the retard nip after the top sheet has passed.

Figure 4:
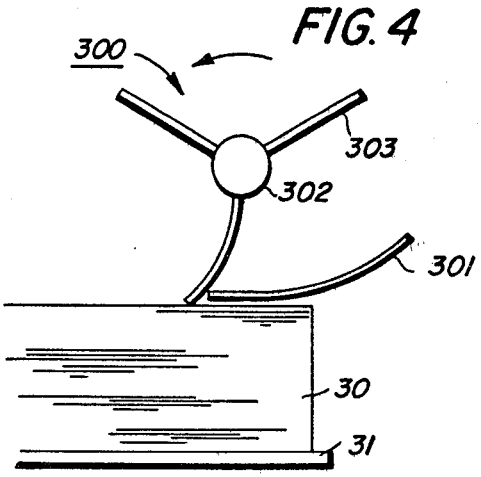
FIG. 4 is an enlarged partial side view of the present invention incorporating the inteceptor plate.
Figure 5:
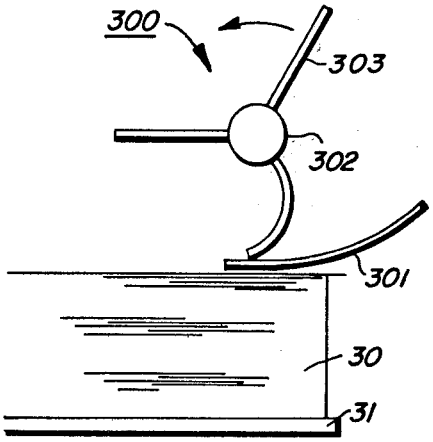
FIG. 5 is an enlarged partial side view of the invention shown in FIG. 4 showing a substrate having been fed forward while a paddle strikes the inteceptor plate.

The invention as shown in FIG. 1 also includes an aspect as shown in FIGS. 4 and 5 in which paddle wheel 302 is located above a stack of sheets 30 held on tray 31. An interceptor plate 301 is shown above the lead edge of the stack such that the blades 303 of paddle wheel 302 contact the plate after the point of maximum sheet acceleration. In this manner, the normal force load is eliminated between the paddle blades and the stack after the point of maximum sheet acceleration. In operation, paddle wheel 302 is rotated in the direction of the arrow causing blades 303 to strike the top sheet in stack 30. As shown in FIG. 5, continued rotation of paddle wheel 302 results in the top sheet being separated from the stack while blades 303 encounter interceptor member 301, thereby removing the normal load previously applied to the stack.

The embodiment of the invention shown in FIG. 1 that combines paddle wheel inertial separation and registration with friction retard separation has numerous advantages over conventional friction retard feeders. For example, reduced mis-feeds are enhanced due to multiple attempts by the urging paddle wheel 110 with each paddle or blade 111 achieving the maximum low slip velocity coefficient of friction. Also, the probability of sheets stubbing in the retard region is reduced since retard wheel 110 is operated out of phase with paddle wheel 120. Other advantages of this invention over prior retard feeders include pre-separation of most sheets by the first paddle wheel, greater positional tolerance of the stack top with respect to the means for urging the paper into the retard region, reduced mis-feeds since the retard region has an extended nip zone which allows repeated attempts at separating any multiple sheets present while the sheets wait at the registration fingers by the retard action of roll 130 acting out of phase with the urging action of paddle wheels, and low unit manufacturing cost.

Figure 2:
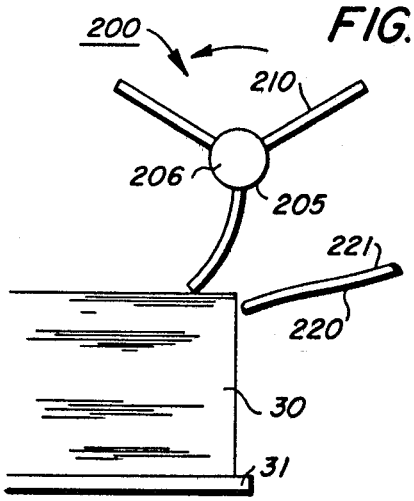
FIG. 2 is an enlarged partial side view of a substrate feeder system according to another aspect of the present invention which could be employed in the printing machine shown in FIG. 1.
Figure 3:
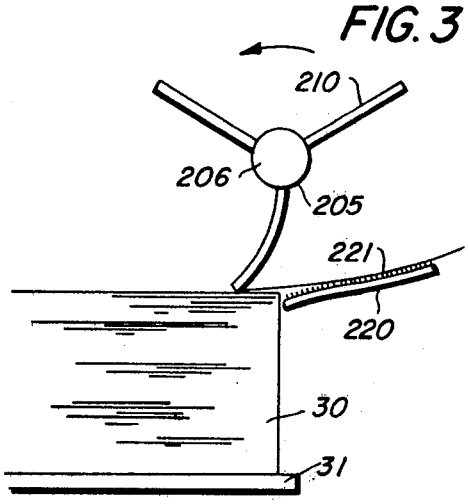
FIG. 3 is an enlarged partial plan view of the feeder in FIG. 2 showing a substrate having been fed from a stack of substrates.

As an alternative to the two paddle wheel feeder approach combined with a retard roll shown in FIG. 1, paddle wheel feeder 200 is disclosed in FIGS. 2 and 3 that employs a single paddle wheel 205 that has blades or paddles 210 attached thereto. Prior paddle wheel inertial feeders relied only on the inertia of the sheets of paper, paddle to paper and paper to paper friction. This improvement has the ability to handle differential inter-sheet friction and comprises a paddle wheel 205 in conjunction with an additional guide member 220 that has a friction surface 221. The friction surface guide member 220 is positioned adjacent the lead edge of the stack and the paddle wheel 205 is critically positioned so that the axis of hub or shaft 206 is in front of the lead edge of the stack with the stack height being controlled relative to the frictional guide surface by conventional means, such as a tray elevator or a simple mechanically controlled escapement system. Also, the friction surface 221 is preferably of a material such as cork that has a coefficient of friction against paper that is less than the paddle wheel to paper friction coefficient but greater than paper to paper friction.

In operation, paddles 210 urge one or more sheets from the top of stack 30. As the sheet or sheets move forward, their lead edges are pinched between the friction surfaced guide 220 and the paddle wheel blades 210. A single sheet continues to be urged forward by the differential friction advantage of the paddle to paper interface versus the paper to friction surface interface. If two or more sheets are fed between the paddles 210 and the friction surface, further motion of the bottom sheet is inhibited by the differential friction of the friction surface to paper interface versus the paper to paper interface.

A critical aspect of the invention shown in FIGS. 2 and 3 involves the location of the axis of hub 206 in front of the lead edge of the stack 30. This location enables elimination of the normal force of the paddle wheel blades 210 on the stack of paper a controlled distance after the blades contact the top sheet. It can be shown that motion of the top sheet is initiated shortly after the blade first contacts the sheet and well before the maximum normal load is reached and that the period immediately following initial contact is also the time of maximum acceleration.

Basically, high acceleration serves to retard adjacent sheets relative to the top sheet but maintaining a normal load between blades 210 and the stack after the point of maximum acceleration reduces the sheet separation capability of the feeder, therefore, positioning the paddle wheel so that the blades pass over the stack edge shortly after the point of maximum sheet acceleration removes frictional coupling forces between the sheets and thereby improves the separation performance of the feeder. It should be understood that paddle wheel 205 could be employed as a feeder without friction surfaced guide 220 if desired. However, if this approach is selected, the blades 210 should be selected to have viscous properties such that the blade paths continue substantially forward as they "jump" off the end of the paper stack.

In conclusion, an improved friction retard paddle wheel feeder is disclosed that combines the benefits of paddle wheel feeders with the benefits of friction retard feeders and in one aspect comprises a first paddle wheel for forwarding sheets individually from a stack of sheets toward a second forwarding feeding paddle wheel located downstream of the first paddle wheel. A retard means is positioned adjacent the second paddle wheel and forms a nip therewith to further prevent multi-feeds. In another aspect, a substrate feeder is disclosed that comprises a paddle wheel mounted over the leading edge of sheets in the stack such that the axis of the paddle wheel is forward of the lead edge of the stack. The paddle wheel can be used with or without a friction surfaced guide member positioned adjacent to the stack lead edge.

It is therefore, evident that there has been provided in accordance with the present invention, a paper feeding system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A substrate sheet feeding apparatus, comprising:

at least one high friction tipped member movable in a path so as to intersect with the plane of a substrate to be fed and apply a normal force thereto;

means for moving said high friction tipped member through said path; and intercept means for relieving said normal force after the initial contact of said friction tipped member with said substrate by lifting said friction tipped member out of contact with said substrate sheet before said normal force reaches a maximum value.

2. Apparatus according to claim 1 including a second assembly of friction tipped members located beyond the initial position of the substrate lead edge, said second assembly forming a working nip with a friction surfaced substrate member and contacting said substrate out of phase with said at least one friction tipped member.

* * * * *